US006585128B2

(12) United States Patent
Clevenger et al.

(10) Patent No.: US 6,585,128 B2
(45) Date of Patent: Jul. 1, 2003

(54) OIL BREATHER SPLASH GUARD STRUCTURE

(75) Inventors: William Andrew Clevenger, Knoxville, TN (US); Friedrich Konrad Diecke, Knoxville, TN (US); Eric Taylor Spurgeon, Lenoir City, TN (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/845,548

(22) Filed: Apr. 30, 2001

(65) Prior Publication Data

US 2002/0158073 A1 Oct. 31, 2002

(51) Int. Cl.[7] ..... B65D 51/16

(52) U.S. Cl. ..... 220/303; 220/373; 220/746

(58) Field of Search ..... 220/562, 563, 220/582, 203.03, 259.3, 259.4, 303, 371, 369, 373, 731, 734, 746–748; 222/564, 547

(56) References Cited

U.S. PATENT DOCUMENTS

| | | | | | |
|---|---|---|---|---|---|
| 1,841,691 | A | * | 1/1932 | Wilson | 220/746 |
| 2,494,679 | A | * | 1/1950 | Ward, Jr. | 220/372 |
| 2,603,308 | A | * | 7/1952 | McCall | 220/372 |
| 2,849,147 | A | * | 8/1958 | Thompson | 220/374 |
| 3,091,373 | A | * | 5/1963 | Kirschenbaum | 222/547 |
| 3,297,211 | A | * | 1/1967 | Unger | 222/547 |
| 3,563,422 | A | * | 2/1971 | Cruikshank | 222/547 |
| 3,811,006 | A | * | 5/1974 | Burnell et al. | 137/550 |
| 3,902,632 | A | * | 9/1975 | Baker et al. | 220/747 |
| 4,410,100 | A | * | 10/1983 | Simmons et al. | 220/747 |
| 4,696,409 | A | * | 9/1987 | Vize | 137/43 |
| 5,564,749 | A | | 10/1996 | Branham | |
| 6,357,619 | B1 | * | 3/2002 | Schaefer | 220/713 |
| 6,386,138 | B1 | * | 5/2002 | Schramm | 220/731 |

OTHER PUBLICATIONS

Picture by Deere & Company employee, Case 1845C Cap Design/Breather for skid steer loader, one page, publication date—2000, published in U.S.A.

Picture by Deere & Company employee, Caterpillar 226 Tank Strap/Breather for skid steer loader, one page, publication date—2000, published in U.S.A.

Picture by Deere & Company employee, New Holland 4475 Cap Design/Breather/Fill Location for skid steer loader, one page, publication date—2000, published in U.S.A.

Picture by Deere & Company employee, Bobcat 763 Breather/Cap Design/Dipstick/Fill for skid steer loader, one page, publication date—2000, published in U.S.A.

Picture by Deere & Company employee, Bobcat 773G Breather for skid steer loader, one page, publication date—2000, published in U.S.A.

Picture and drawing by Deere & Company employees, breather structure for John Deere 200 Series skid steer loader, two pages, publication date—2000, published in U.S.A.

* cited by examiner

*Primary Examiner*—Nathan J. Newhouse

(57) ABSTRACT

A two stage splash guard structure is provided for an oil breather usable with an hydraulic fluid reservoir or tank. The first splash guard is provided within a neck portion preferably formed as part of the tank. A bowl-like cavity is formed within the neck portion and a ring-like chamber surrounds the cavity to serve as the first stage splash guard. An orifice is provided in the lower portion of the bowl to allow for the flow of air through the neck portion and into and out of the tank as the fluid in the tank shifts or rises and falls. A shelf is formed within the bowl to receive a second stage splash guard plate. A hollow adapter is then threadably secured within the neck portion to secure the second stage splash plate in place on the shelf and an air breather cap with the filtering element is threadably secured to the adapter.

9 Claims, 5 Drawing Sheets

FIG. 6
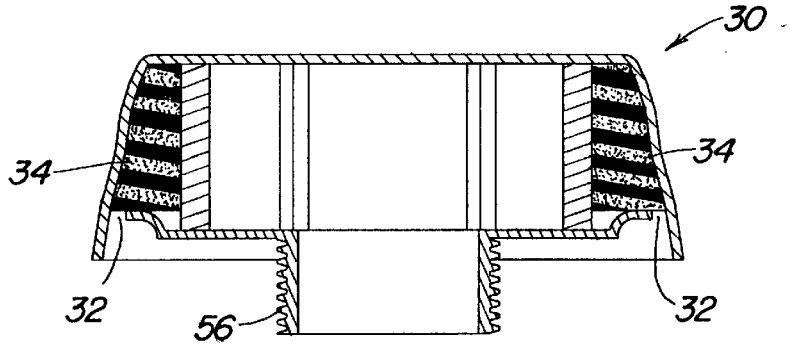
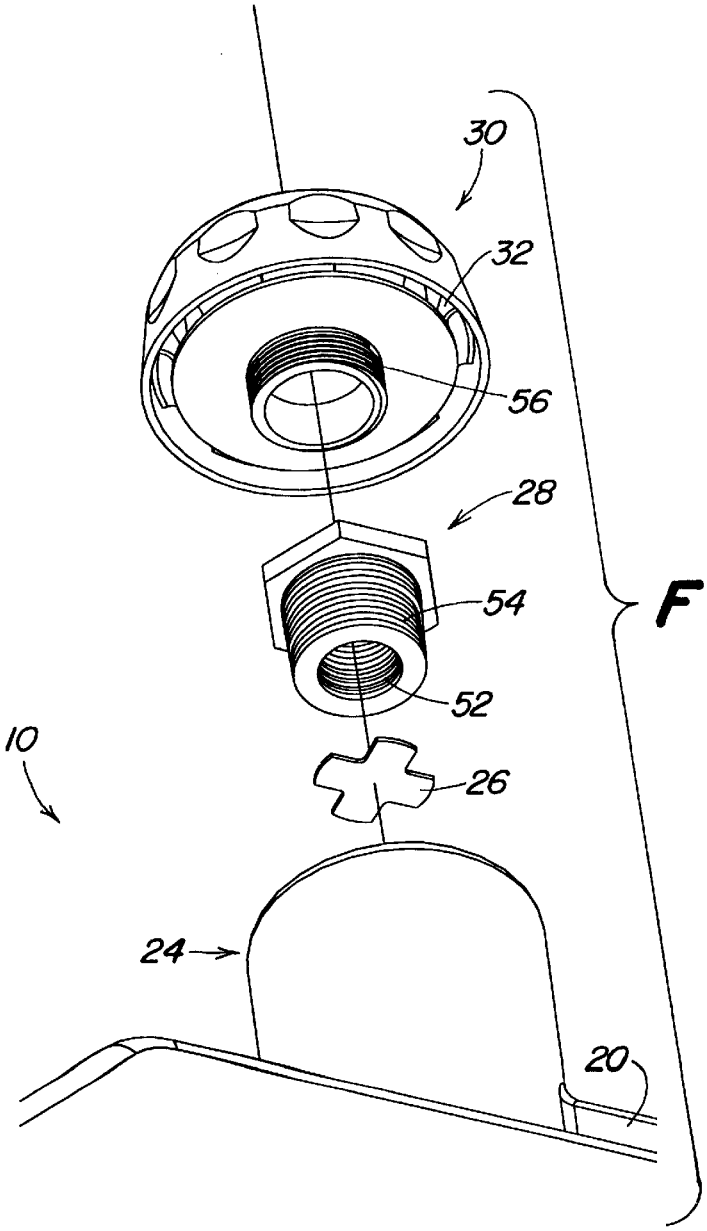
FIG. 4

OIL BREATHER SPLASH GUARD STRUCTURE

FIELD OF THE INVENTION

The present invention relates to vehicles having fluid reservoirs open to the atmosphere such as an hydraulic oil tank and to the air breather structure that permits air to enter and exit the tank as fluid rises and falls or shifts during operation of the vehicle.

BACKGROUND OF THE INVENTION

Vehicles having hydraulic cylinders and other devices actuated by hydraulic oil have reservoirs or tanks to store and be a source of fluid as the cylinders and other devices are operated.

These tanks are provided with vents to maintain atmospheric pressure in the tank as the oil levels change. Since the vents are open to the atmosphere, there has to be provision for retaining oil as well as airborne oil particles in the tank while permitting air to enter and exit the tank as oil levels change.

To retain the oil within the tank, two basic approaches have been utilized. The first provides for a long tube to be attached to the tank for venting air into and out of the tank. The very length of the tube minimizes the amount of oil that is splashed up the tube. These tubes are further provided with breather caps at their upper end to prevent oil or airborne oil particles from passing out the vent of the cap. Since the caps are equipped with filtering elements such as foam that serve to retard movement of airborne oil particles out the cap, the cap with its filtering element must be frequently replaced. Further, the very length of the tubes increases part costs and the space they require presents engine compartment design problems.

A second approach used to retain oil and airborne oil particles within the tank as the levels change utilizes a short tube connected to the tank with a splash plate provided within the tube. The plate blocks a major portion of the tube but is configured to permit air to flow around or through it. While this configuration serves to reduce the amount of oil reaching the filtering element in the cap, reduces the frequency at which the filtering element and cap have to be serviced and/or replaced, reduces the cost of a long tube and overcomes its inherent design constraints, it too requires several expensive parts. Further, it also permits an undesirable amount of oil to pass the splash plate, thereby requiring a higher than desirable rate of servicing of the replaceable cap and filtering element.

An additional disadvantage associated with the second design is that it has been attached to the tanks by a threaded connection. Because a great number of tanks today are produced through a rotomolding process to provide a configuration compatible with engine compartment space constraints, any threads formed in the tank are soft. With the threaded splash guard parts that are attachable to the tank being made of harder materials, the threads within the tank can easily be ruined when the splash guard structure is removed and/or installed, thereby requiring replacement of the tank itself.

SUMMARY OF THE INVENTION

Accordingly, it would be desirable to provide a splash guard structure for an oil breather and a hydraulic reservoir tank that is compact, reasonably inexpensive and does not unduly interfere with the placement of other components in the engine compartment. It would also be desirable to provide a splash guard structure that has improved effectiveness in retarding movement of oil and airborne oil particles through and out of the breather. It would further be desirable to provide a splash guard structure that can be used with the softer plastic common in rotomolded tanks.

Towards these ends, there is provided a splash guard structure for a rotomolded tank that includes a two stage splash guard arrangement. A first splash guard is provided within a neck portion formed as part of the tank. A bowl-like cavity is formed in the neck portion with a surrounding ring-like chamber that serves as the first stage splash guard. An orifice is provided in the lower portion of the bowl to allow for the flow of air through the neck portion and into and out of the tank as the fluid in the tank shifts or rises and falls. A shelf is formed within the bowl to receive a second stage splash guard plate. A hollow adapter is then threadably secured within the neck portion to secure the second stage splash plate in place on the shelf and an air breather cap with the filtering element is threadably secured to the adapter.

With the first and second stage splash guards, fewer airborne oil particles can pass to the filtering element in the cap and less service is thereby required. Securing the cap to the adapter avoids the repeated threading of a harder plastic part into and out of the soft tank threads, thereby increasing the life of the tank.

BRIEF DESCRIPTION OF THE DRAWINGS

FIG. 4 is an enlarged perspective view illustrating the oil breather structure in an exploded manner.

FIG. 6 is an enlarged sectional view illustrating the oil breather cap.

DESCRIPTION OF THE PREFERRED EMBODIMENT

Figure 1:
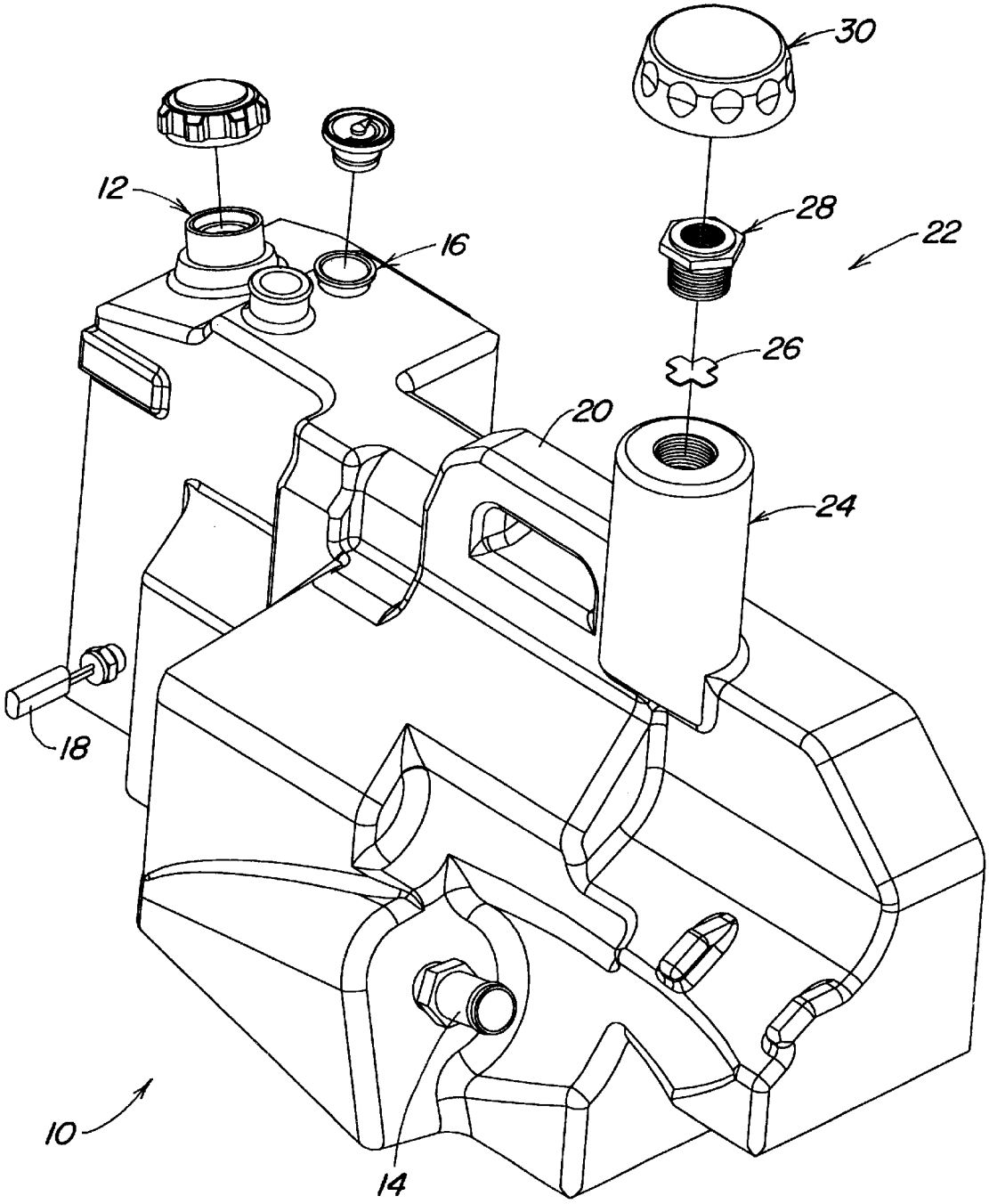
FIG. 1 is a front elevated perspective view of an oil reservoir tank illustrating the oil breather components in an exploded fashion.

Looking to FIG. 1, there is illustrated an elevated perspective view of an oil tank or reservoir 10 of the type which could be used in a vehicle such as a skid steer loader. The tank 10 of the preferred embodiment is produced from a rotomolding process and utilizes a soft plastic in order to form the tank 10 in a configuration that fits between other components carried within the chassis of the vehicle.

The tank 10 includes a fill location or opening 12 at one upper end wherein fluids such as hydraulic oil can be poured into the tank 10. The tank 10 further includes an outlet 14 at one lower end where fluid is taken from the tank 10 and circulated to vehicle devices such as hydraulic cylinders which may require the use of hydraulic fluid. At the other end of the tank 10 and at a top portion is provided an inlet 16 for fluid to be returned to the tank 10 after being routed to the work devices on the vehicle. At the lower portion of the tank 10 is provided a sensor 18 that gauges the oil temperature. The particular tank 10 provided in the preferred embodiment includes a handle 20 which allows it to be easily manipulated during manufacturing and/or replacement activities.

At the forward portion of the handle 20 is provided an oil breather structure 22 which is the subject of the present invention. The oil breather structure 22 includes an outwardly extending hollow tubular neck portion 24 that is formed as a part of the rotomolding process to be part of the tank 10. Further included is a generally X-shaped splash guard plate 26, an adapter component 28 and a breather cap 30 with air vents 32 provided in its lower edges and a filtering element 34 at its underside, see FIG. 4.

Figure 2:
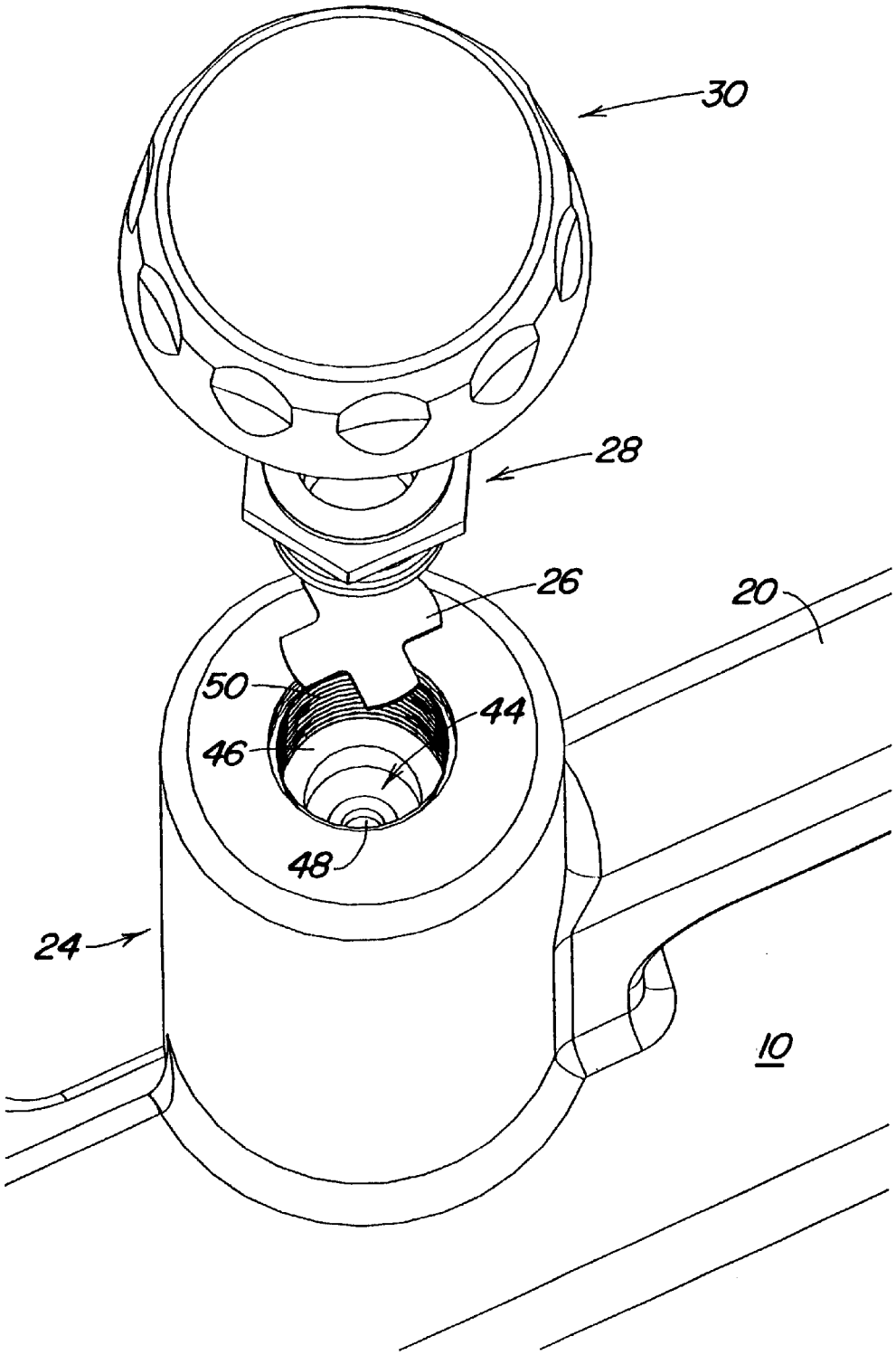
FIG. 2 is an enlarged elevated perspective view illustrating the oil breather structure in an exploded view.
Figure 3:
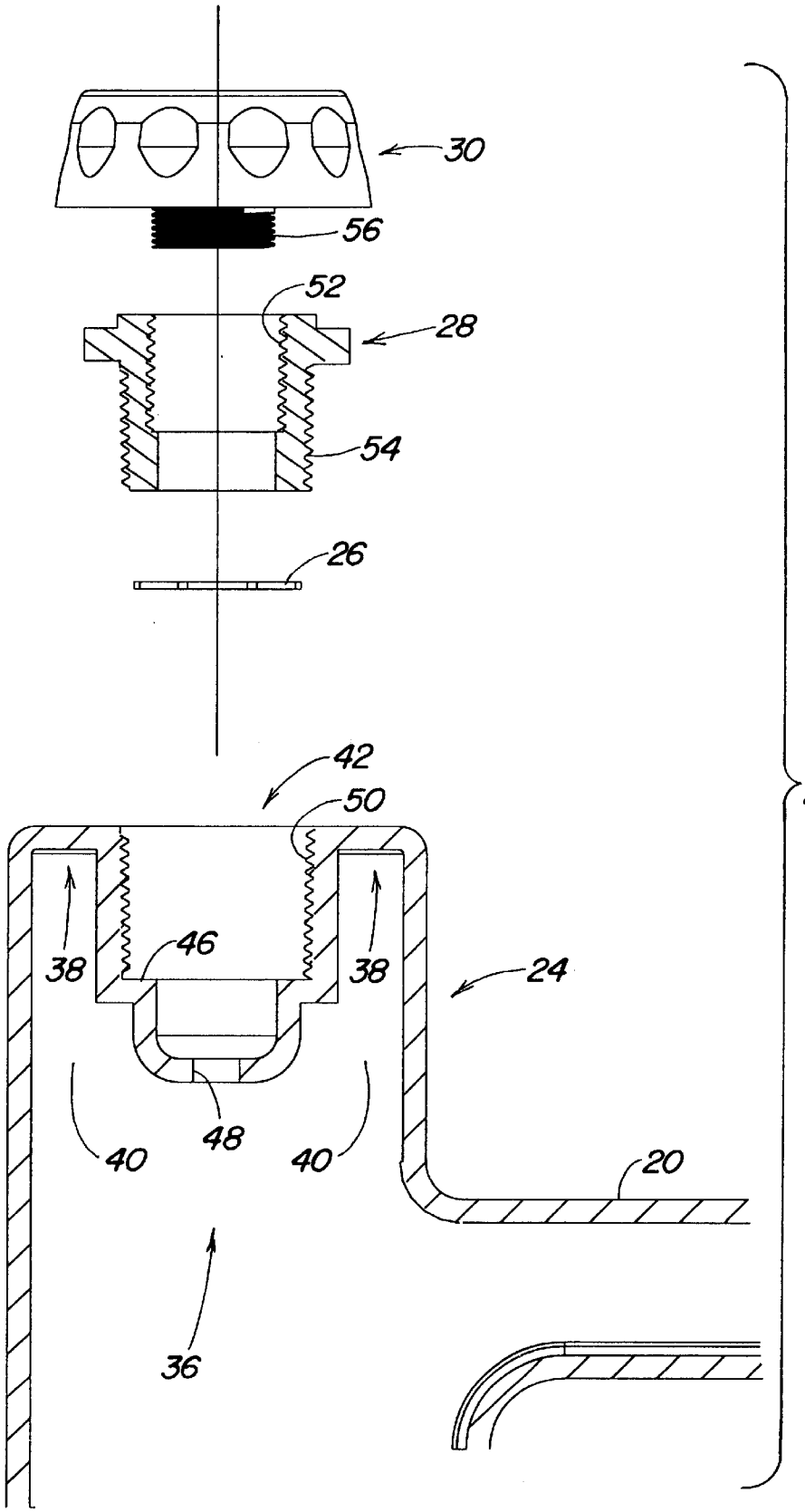
FIG. 3 is an enlarged side sectional view of the oil breather structure.

Looking as well to FIGS. 2 and 3 which better illustrate the oil breather structure 22, it can be seen that the hollow tubular neck portion 24 which extends up from the tank 10 includes an annular cavity 36 which has a top 38 as well as a bottom 40 formed within it. This cavity 36 is open at the bottom and closed at the top. It is this cavity 36 which serves as a first stage splash guard for oil that may be splashed towards the top of the tank 10 as the vehicle is operated and/or the levels in the tank 10 change. While the neck portion 24 is illustrated as a hollow cylindrical sleeve, it could have an inclined or curved configuration to accommodate adjacent components as long as it contained the hollow cavity 36 that serves as the first stage splash guard.

The cavity 36 further has a set of inner walls 42 in the form of a circular ring or sleeve which define a bowl 44. This bowl 44 is provided with an annular ledge 46 as is best seen in FIGS. 2 and 3, on the inner perimeter of the bowl 44. An orifice 48 is provided at the lower end of the bowl 44 to allow for the passage of air into and out of the tank 10.

On the interior surface of the bowl 44 are provided threads 50 wherein the adapter 28 can be threadably received. The adapter 28 is provided with both internal and external threads 52 and 54, the external threads 54 being those which would mate with the internal threads 50 in the bowl 44 in order to secure the adapter 28 in the bowl 44. In the preferred embodiment, the adapter 28 is made of harder plastic material to be more durable while the plastic utilized in the rotomolded tank 10 is made of a softer plastic in order to allow it to be configured compatibly with other design limitations in the vehicle chassis. The adapter 28 is provided with an opening through the middle of it through which air can also pass to and from the tank 10 as it moves through the orifice 48 in the bottom of the bowl 44.

The cap 30, illustrated in FIG. 6, is conventional and can be secured to the adapter 28. The breather cap 30 has external threads 56 carried on a hollow sleeve portion, those threads 56 being compatible with the internal threads 52 of the adapter 28.

As is illustrated in FIGS. 3, 4, 5 and 6, the breather cap 30 is provided with a hollow central portion and a vent 32 in its underside that allows air to pass between the tank 10 and atmosphere. A breather element 34 which could be of a foam or cardboard type material encircles the spaced apart structural columns 59 at the center portion of the cap 30. The element 34 serves to maintain in the cap 30 any oil that may splash up and into it, so that it may drain back down into the tank 10. Further, the breather element 34 serves to absorb airborne oil particles and prevent their exit from the vent 32 as well. The cap 30 and its filtering element 34 are replaceable so that they can be easily replaced when it becomes filled with oil.

Figure 5:
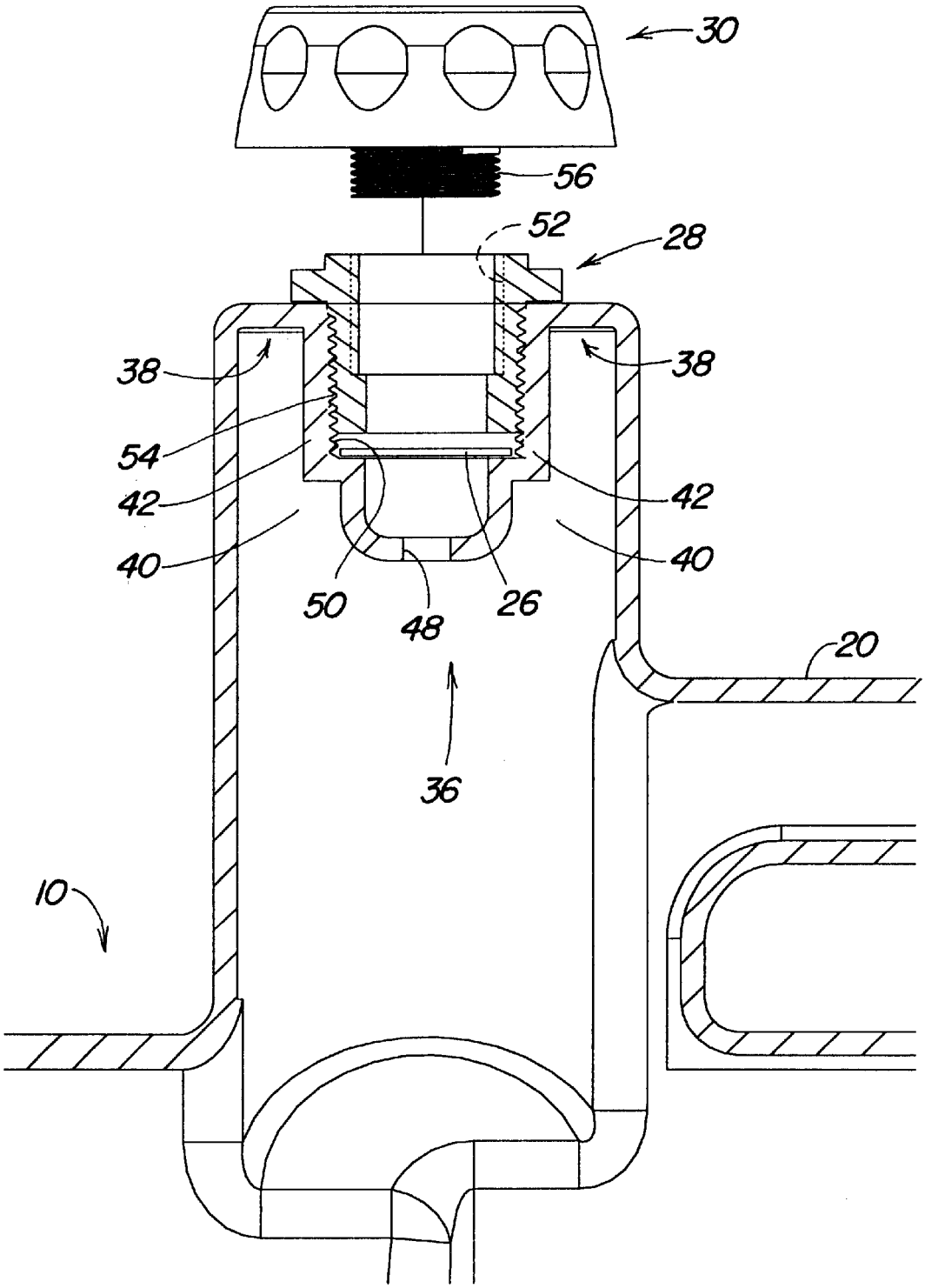
FIG. 5 is an enlarged side sectional view illustrating the oil breather components, with the exception of the breather cap, in their assembled arrangement.

Looking now to FIG. 5, there is shown the adapter 28 and splash guard plate 26 in their assembled configuration. When the adapter 28 is threadably received in the threads 50 of the bowl 44, it secures the first stage splash plate 26 in place on the ledge 46 provided within the bowl 44. The breather cap 30 is in turn threadably received in the adapter 28, providing a very short oil breather apparatus at the top portion of the tank 10.

When a vehicle such as a skid steer loader equipped with the present invention is operated, oil would be taken from the tank 10 to activate hydraulic cylinders and similar types of devices, lowering the level of the fluid in the tank 10. Similarly, as the vehicle is operated on uneven terrain, the level of the fluid in the tank 10 would shift and splash about. As these changes in the level and position of oil in the tank 10 occur, it is necessary to maintain the tank 10 with the air pressure substantially equivalent to that outside of the tank 10, that is, atmospheric pressure. Accordingly, the vent 32 allows air to enter the cap 30, pass through the filtering element 34 and enter the tank 10 when fluid is directed from the tank 10 to the hydraulic devices or splashes about during operation. However, during such movement of the fluid in the tank 10, it is not uncommon for oil or the fluid to splash up the air breather structure 22. Accordingly, there is provided in the present invention a two stage splash guard structure that would minimize the amount of oil that can make its way up the air breather structure 22 and out the air vent 32 of the cap 30.

This two-stage oil splash guard structure is comprised of a first stage that is formed within the neck portion 24 of the tank 10, that is, the annular cavity 36 that is provided in the top end of the neck portion 24. As oil enters the oil breather structure 22, it splashes against the top portion of the cavity 36 and drains back down into the tank 10. Any oil that would splash up the orifice 48 at the lower end of the bowl 44 would impact against the second stage of the splash guard structure, that is, the X-shaped splash plate 26. The splash plate 26 is configured in an X-shape to provide openings between it and the ledge 46 it is seated on to permit the movement of air past it and to or through the vent 32 in the cap 30.

While the preferred embodiment utilizes a neck portion 24 that is formed as a part of the tank 12, the neck portion could be formed separately and then installed on a tank. For example, the tank could be provided with a threaded opening into which a neck portion having external threads could be removably received.

With the present invention, there is provided a two-stage oil breather splash guard structure that minimizes the amount of oil as well as airborne oil particles that are allowed to move up the breather structure and exit. The oil breather element further captures airborne oil particles so that that type of leakage is also inhibited.

Having described the preferred embodiment, it will become apparent that various modifications can be made without departing from the scope of the invention as defined in the accompanying claims.

I claim:

1. A splash guard structure for use with a fluid reservoir, said structure including:

a hollow tubular neck integrally formed in the reservoir and having outer walls extending from the tank outwardly to a shoulder;

a first cylindrically shaped sleeve portion adjoining the shoulder and including first walls extending into the neck and spaced from the outer walls to form an annular cavity therebetween, said first walls including a threaded interior periphery;

a shelf provided in the inner periphery of the first walls;

a second cylindrically shaped sleeve portion including second walls adjoining the shelf and extending from the shelf into the neck, said second portion including a base;

an orifice provided in the base;

a splash plate adapted to be seated on the shelf, said plate configured to permit airflow to and from the reservoir;

a hollow cylindrically shaped adapter having first and second threaded portions, the adapter being sized to allow its first threaded portion to be threadably secured to the threaded interior periphery of the first sleeve portion, and a breather cap adapted to be threadably secured to the adapter, said cap having an orifice therethrough and a seat for securing a removable breather element.

2. The invention defined in claim 1 wherein the shelf is ring-shaped.

3. The invention defined in claim 1 wherein the first threaded portion is on the interior surface of the adapter and the second threaded portion is on the exterior surface of the adapter.

4. A splash guard structure for use in a rotomolded fluid tank having an outwardly extending hollow tubular first neck portion with outer walls integrally formed as a part of the tank;

said neck portion including an inwardly extending hollow second neck portion with inner walls having interior threads and a shelf, as well as a third hollow b neck portion having inner walls coupled to the shelf and extending inwardly therefrom, said third portion including an orifice in a lower portion to permit the flow of air therepast;

an annular cavity formed within the tank between the outer walls of the first neck portion and the inner walls of the second neck portion;

a splash plate receivable on the shelf, and being configured to permit airflow to and from the tank;

a hollow adapter having first and second threaded portions, the first threads being receivable in the internal threads of the second neck portion; and a breather cap having a threaded surface receivable in the second threaded portion of the adapter, said cap including a removable breather element and an orifice in said cap to provide for movement of air therethrough.

5. The invention defined in claim 4 wherein the first threaded portion is on the interior surface of the adapter and the second threaded portion is on the exterior surface of the adapter.

6. A splash guard structure for use with a fluid tank comprising:

an outwardly extending hollow tubular neck portion connected to and extending from the tank;

an annular cavity having a top and bottom formed within the neck portion, said cavity being open at the bottom and closed at the top;

the cavity further having inner walls which define a bowl, the bowl providing an orifice in a lower end thereof;

an annular ledge provided in the inner perimeter of the bowl; and a splash plate adapted to be seated on the ledge, said plate being configured in an X-shape so as to permit the flow of air past it.

7. A splash guard structure for use with a fluid tank comprising:

an outwardly extending hollow tubular neck portion connected to and extending from the tank;

an annular cavity having a top and bottom formed within the neck portion, said cavity being open at the bottom and closed at the top;

the cavity further having inner walls which define a bowl;

an annular ledge provided in the inner perimeter of the bowl;

an orifice provided in the lower end of the bowl, the inner walls of the bowl including a threaded portion above the ledge;

a hollow adapter having external and internal threaded portions, the adapter being threadably receivable in the threaded portion of the inner walls;

an oil breather cap having an orifice therein and a portion with external threads which are threadably receivable in the internally threaded portion of the adapter; and a splash plate adapted to be seated on the ledge, said plate configured to permit the flow of air past it.

8. A splash guard structure for use with a fluid tank comprising:

an outwardly extending hollow tubular neck portion connected to and extending from the tank;

an annular cavity having a top and bottom formed within the neck portion, said cavity being open at the bottom and closed at the top;

the cavity further having inner walls which define a bowl;

an annular ledge provided in the inner perimeter of the bowl;

an orifice provided in the lower end of the bowl, the inner walls of the bowl including a threaded portion above the ledge;

a hollow adapter having external and internal threaded portions, the adapter being threadably receivable in the threaded portion of the inner walls;

an oil breather cap having an orifice therein, a portion with external threads which are threadably receivable in the internally threaded portion of the adapter, and a replaceable element designed to absorb airborne oil particles and prevent their exit through the orifice; and a splash plate adapted to be seated on the ledge, said plate configured to permit the flow of air past it.

9. A splash guard structure for use with a fluid tank comprising:

an outwardly extending hollow tubular neck portion connected to and extending from the tank;

an annular cavity having a top and bottom formed within the neck portion, said cavity being open at the bottom and closed at the top;

the cavity further having inner walls which define a bowl;

an annular ledge provided in the inner perimeter of the bowl;

an orifice provided in the lower end of the bowl, the inner walls of the bowl including a threaded portion above the ledge;

a hollow adapter having external and internal threaded portions, the adapter being threadably receivable in the threaded portion of the inner walls;

an oil breather cap having an orifice therein, a portion with external threads which are threadably receivable in the internally threaded portion of the adapter, and a replaceable element designed to absorb airborne oil particles and prevent their exit through the orifice; and a splash plate adapted to be seated on the ledge, said plate configured to permit the flow of air past it.

* * * * *